US006325708B1

(12) United States Patent
Miles

(10) Patent No.: US 6,325,708 B1
(45) Date of Patent: Dec. 4, 2001

(54) DEVICE FOR SANDING A DRYWALL CORNER

(76) Inventor: Jody W. Miles, 2112 Haig Point Way, Raleigh, NC (US) 27604

( * ) Notice: Subject to any disclaimer, the term of this patent is extended or adjusted under 35 U.S.C. 154(b) by 0 days.

(21) Appl. No.: 09/672,534

(22) Filed: Sep. 28, 2000

(51) Int. Cl.[7] ..... B24B 23/00

(52) U.S. Cl. ..... 451/354; 451/344; 451/524; 451/525

(58) Field of Search ..... 451/344, 354, 451/490, 523, 524, 525

(56) References Cited

U.S. PATENT DOCUMENTS 2,817,931 * 12/1957 Houser ..... 451/525
3,192,678 * 7/1965 Buratti ..... 451/525
3,279,130 * 10/1966 Nelson ..... 451/524
4,825,597 * 5/1989 Matechuk ..... 451/524
5,309,681 * 5/1994 Cheney et al. ..... 451/344
5,605,500 * 2/1997 Matechuk ..... 451/354

* cited by examiner

*Primary Examiner*—Eileen P. Morgan
(74) *Attorney, Agent, or Firm*—Coats & Bennett, P.L.L.C.

(57) ABSTRACT

A device is provided for sanding the drywall compound formed along a drywall corner. The device includes a base and a pad holder, the pad holder being adapted to receive and hold a drywall sanding pad. More particularly, the pad holder is in the form of a generally V-shaped plate that conforms to the shape of the drywall sanding pad. The drywall sanding pad and the pad holder can be provided as an integral component or in the alternative, the drywall sanding pad can be detachably secure to the pad holder through a fastener arrangement such as through an array of hook and loop fasteners.

5 Claims, 4 Drawing Sheets

DEVICE FOR SANDING A DRYWALL CORNER

FIELD OF THE INVENTION

The present invention relates to drywall sanders and more particularly to a drywall sander that is designed to sand a drywall corner.

BACKGROUND OF THE INVENTION

In the process of installing sheet rock or drywall, sheets of the material are usually secured to a stud wall and thereafter the joints and seams existing between the respective sheets are taped and covered with a drywall compound. Thereafter, these seams or joints are sanded which results in a smooth finish being formed along the seam and joint areas. However, in finishing sheet rock or drywall there is one particular area that is known to be problematic when it comes to sanding and finishing. The area being referred to is corner areas where sheets of drywall or sheet rock come together at a juncture to form a corner. The corner is typically finished with a drywall compound and thereafter sheet rock finishers sand and finish these corner areas. Typically the sanding of sheet rock corners is performed by the sheet rock finisher using a rectangular sanding block which is ordinarily about one inch thick. However, it is difficult to efficiently sand dry wall corners with such conventional sanding blocks. One principal problem that is sometimes encountered with using a conventional drywall sanding block is that the sanding block tends to dig grooves in the drywall compound especially in corner areas. The creation of these grooves simply compounds the problem and requires the sheet rock finisher to sand out the grooves which makes the job more laborious and time-consuming.

Therefore, there has been and continues to be a need for a device that is particularly designed to sand and finish drywall corners in an effective and efficient manner without cutting or forming grooves in the drywall compound in and around the drywall corner.

SUMMARY OF THE INVENTION

The present invention entails a drywall sander adapted to receive a generally V-shapid drywall sanding pad. The drywall sander is specifically adapted to sand and finish drywall corners and includes a carrier having a generally V-shaped surface for receiving and holding tie V-shaped sanding pad. Once the V-shaped sanding pad is secured on the carrier, then the carrier is typically moved up and down along the drywall corner with the drywall sanding pad assuming a position between the carrier and the drywall corner.

In one particular embodiment of the present invention, the carrier or base is provided with a pole attachment. An extension pole can be connected to the pole attachment and thus the drywall finisher by attaching a pole to the pole attachment can extend the drywall sander such that it reaches heights of eight to twelve feet, for example.

In a particular embodiment of the present invention, the drywall sander includes a base and a generally V-shaped pad holder with the V-shaped pad holder being adapted to receive and hold a V-shaped sanding pad. In this design, the sander is specifically designed to avoid cutting grooves or lines in the drywall compound formed about the drywall corner. To achieve this result, the drywall sander is designed such that it sands more aggressively along the juncture of the corner and sands less aggressively in areas that lie outwardly of the juncture. Expressed in another way, the drywall sander is designed such that its aggressiveness progressively diminishes from the central portion of the sander towards the outer portions. Thus, the sander tends not to cut grooves or lines in the drywall compound that is found outwardly of the center of the drywall corner.

Other objects and advantages of the present invention will become apparent and obvious from a study of the following description and the accompanying drawings which are merely illustrative of such invention.

BRIEF DESCRIPTION OF THE INVENTION

DETAILED DESCRIPTION OF THE INVENTION

Figure 1:
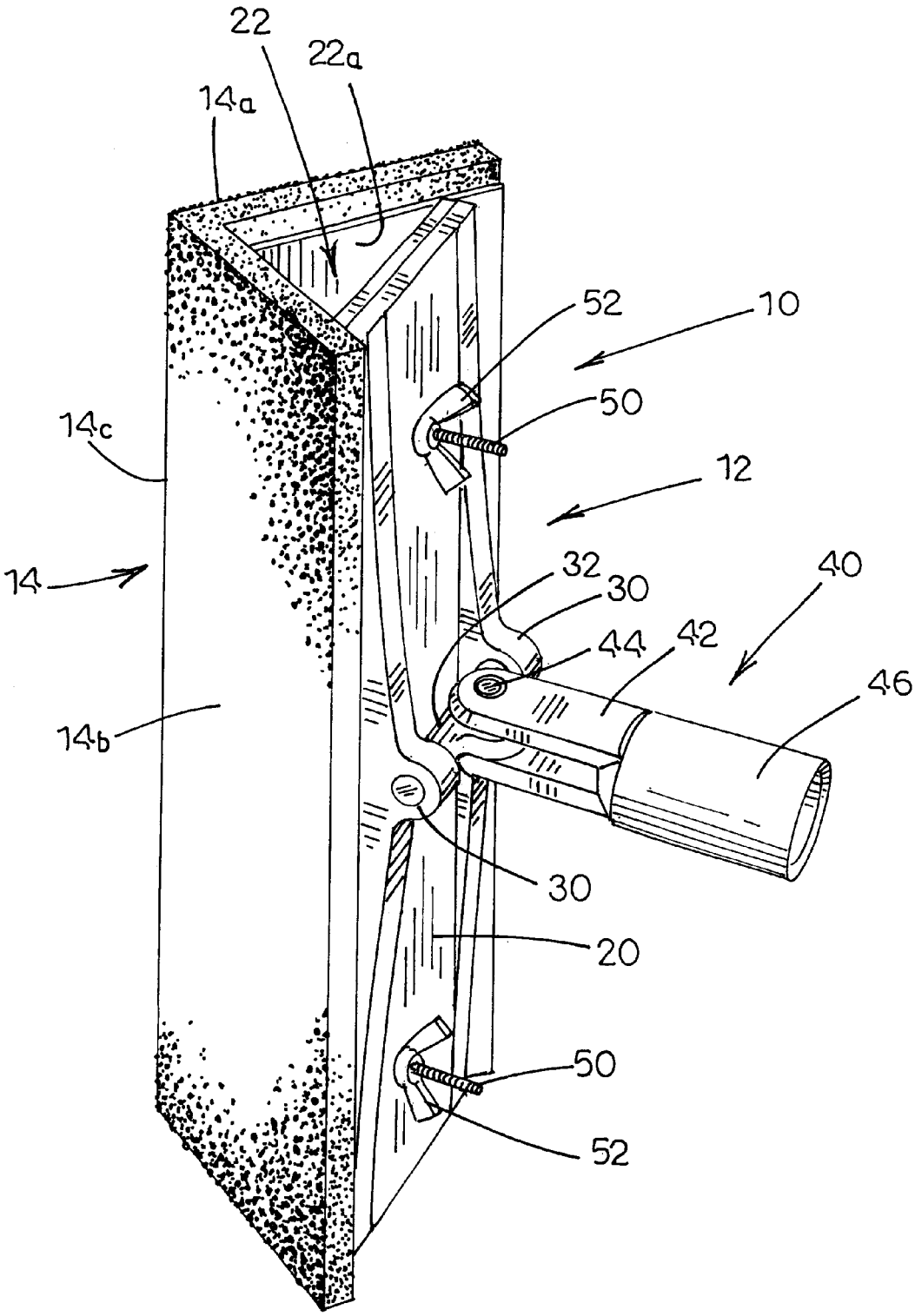
FIG. 1 is a perspective view of the drywall sander of the present invention.

With further reference to the drawings, the drywall corner sander of the present invention is shown therein and indicated generally by the numeral 10. The drywall sander 10 basically comprises a carrier indicated generally by the numeral 12, which is adapted to receive and hold a sanding pad indicated generally by the numeral 14. As will be appreciated from subsequent portions of this disclosure, the sanding pad 14 is particularly designed to sand and finish sheet rock or drywall.

Figure 2:
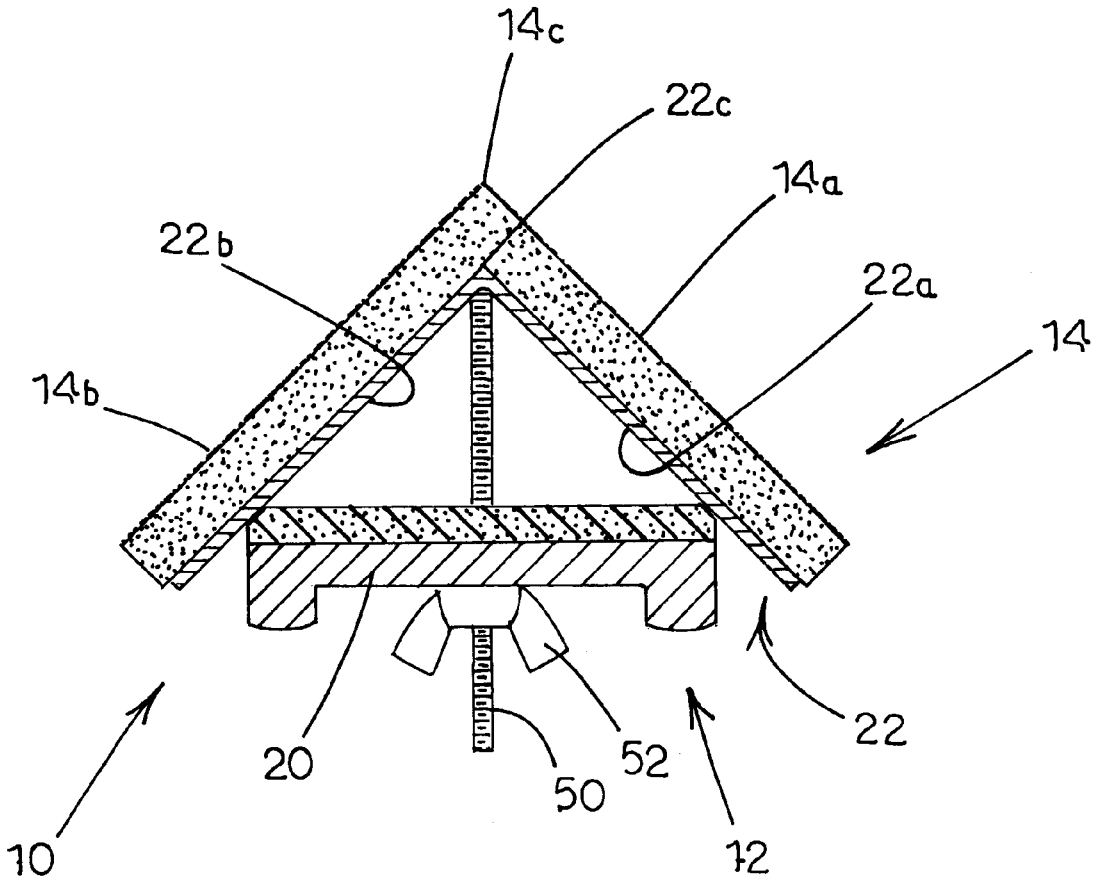
FIG. 2 is a cross-sectional view of the drywall sander showing in FIG. 1.

Viewing the drywall sander 10 in more detail, the carrier 12 includes a base of 20. In the embodiments illustrated herein, the base 20 is elongated and include a plate structure. In particular, as seen in FIGS. 1 and 2, the base 20 comprises a pair of plates disposed in back to back relationships. However, it should be appreciated that the plate structure of the base could simply comprise a single plate or single member. Secured to the base 20 is a sanding pad holder indicated generally by the numeral 22. As seen in the drawings, the sanding pad holder 22 assumes a generally V shape. In particular, sanding pad holder 22 includes a pair of V-shaped surfaces 22*a* and 22*b* and a central edge or ridge 22*c*. The sanding pad holder 22 is adapted to receive and hold the sanding pad 14.

Figure 3:
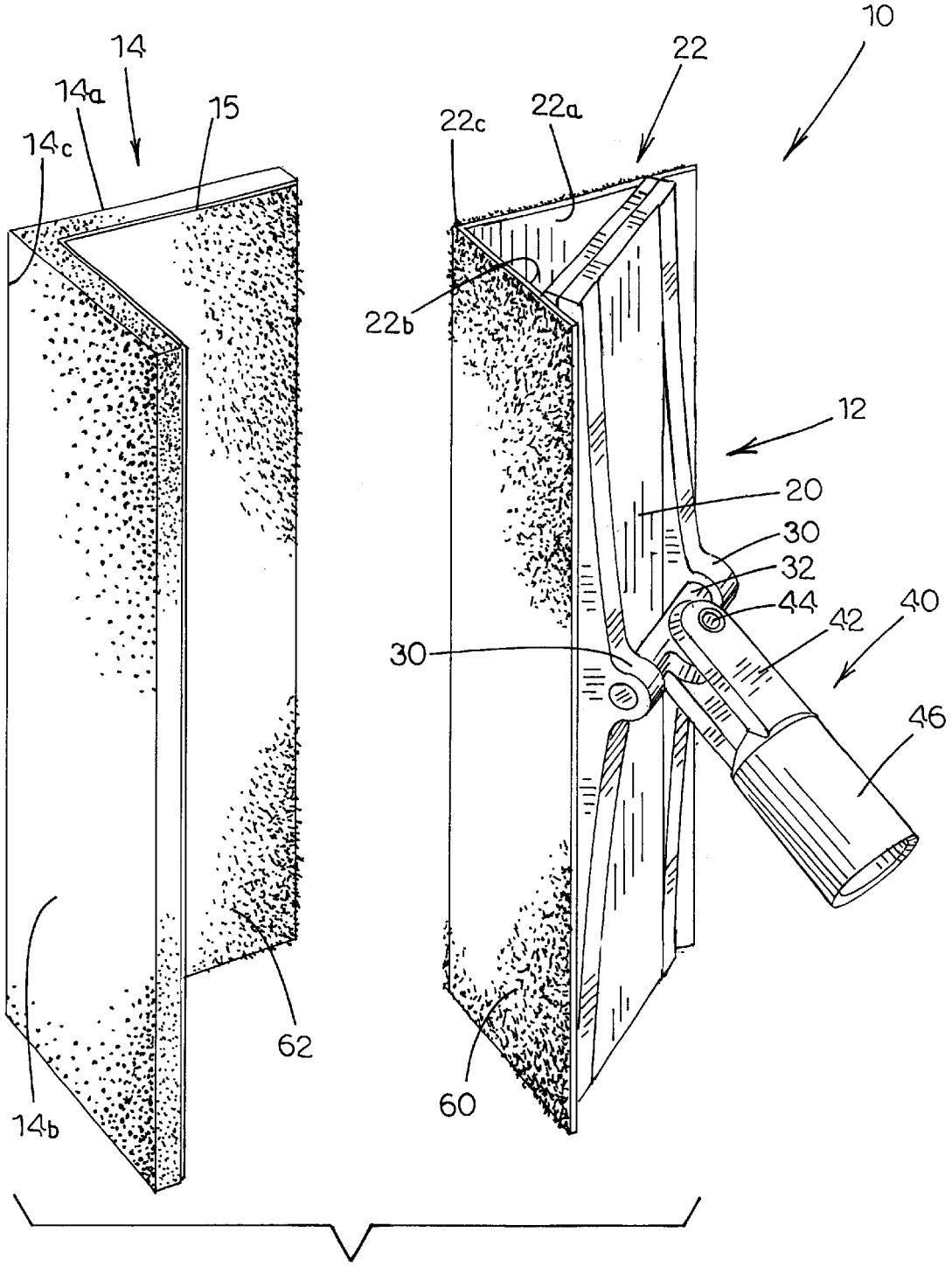
FIG. 3 is an exploded view of a second design for the drywall sander of the present invention.

Returning to base 20, as seen in FIGS. 1 and 3, the base includes a pair of laterally spaced shoulders 30. Each shoulder includes an apperture or opening through which a transverse pivot pin 32 is journaled. Secured to the transverse pivot pin is a pole attachment indicated generally by the numeral 40. The pole attachment includes a yoke 42 having a pivot pin 44 pivotly mounted therein and attached to the transverse pivot pin 32. Extending from the yoke 42 is a pole sleeve 46. The pole sleeve 46 is adapted to receive and connect to an elongated pole that enables the sheet rock finisher to reach elevated heights when using the drywall sander 10.

With particular reference to FIGS. 1 and 2, the drywall sander 10 shown therein comprises a design where the pad holder 22 is detachably mounted to the base of 20. As seen in FIGS. 1 and 2, there is provided a pair of screws or bolts 50 that are fixed to the pad holder 22 and project therefrom. In particular, the base 20 is provided with a pair of spacedapart openings formed therein and the screws or bolts 50 project therethrough. To secure the pad holder 22 to the base 20, there is provided a pair of wing nuts 52.

In the embodiment illustrated in FIGS. 1 and 2 where the pad holder 22 is detachably mounted to the base of 20, the pad holder 22 and the sanding pad 14 may comprise a single unit integrally constructed together or they may be designed to be routinely separated and coupled. However, in the embodiment illustrated in FIGS. 1 and 2, it is contemplated that the pad holder 22 and the sanding pad 14 would be a single integral unit and would be purchased or procured as such. That is, the pad holder and sanding pad would be provided or purchased as a single unit and once the sanding pad has been sufficiently worn, the entire unit would be discarded and a new unit would be provided as a replacement.

Now turning to FIG. 3, in this embodiment, the pad holder 22 is integral with the base 20. That is, the pad holder 22 in this design is permanently attached or formed with the base 20.

In order to receive and hold the sanding pad 14, the sanding pad holder 22 of the design illustrated in FIG. 3, is provided with a detachable fastener arrangement that permits the sanding pad 14 to be detachably secured to the sanding pad holder 22. In the case, of the embodiment shown in FIG. 3, the exposed surfaces of the pad holder 22 and the back or interior surfaces of the sanding pad 14 are provided with hook and loop fasteners. It will be appreciated that the hook and loop fasteners can be provided on either the pad holder or the sanding pad but in this case the hook fasteners 60 are shown on the sanding pad holder 22 while the loop fastener 62 are shown on the interior surfaces of the sanding pad 14. Therefore, it is appreciated that the sanding pad 14 can be quickly and easily attached and detached with respect to the pad holder 22.

With reference to the sanding pad 14, it is noted that in both the embodiments of FIGS. 1 and 3, the sanding pad includes a pair of sanding surfaces 14*a* and 14*b*. Further, the sanding pad 14 includes an elongated leading center edge 14*c*. In the case of the embodiment illustrated in FIG. 1, the sanding pad 14 is glued or otherwise secured to the detachable pad holder 22. In the case of the embodiment of FIG. 3, the sanding pad 14 includes a backing 15. The backing 15 comprises an angle plate or other relatively thin backing material such as aluminum or plastic or the like that is secured to and supports the sanding pad. The sanding pad 14 can be constructed in a number of conventional ways. In the case of the present invention it is contemplated that the sanding pad 14 would basically comprise a resilient core made of foam or a rubber-like material, and an outer abrasive layer of material that would function as a sanding surface.

Figure 4:
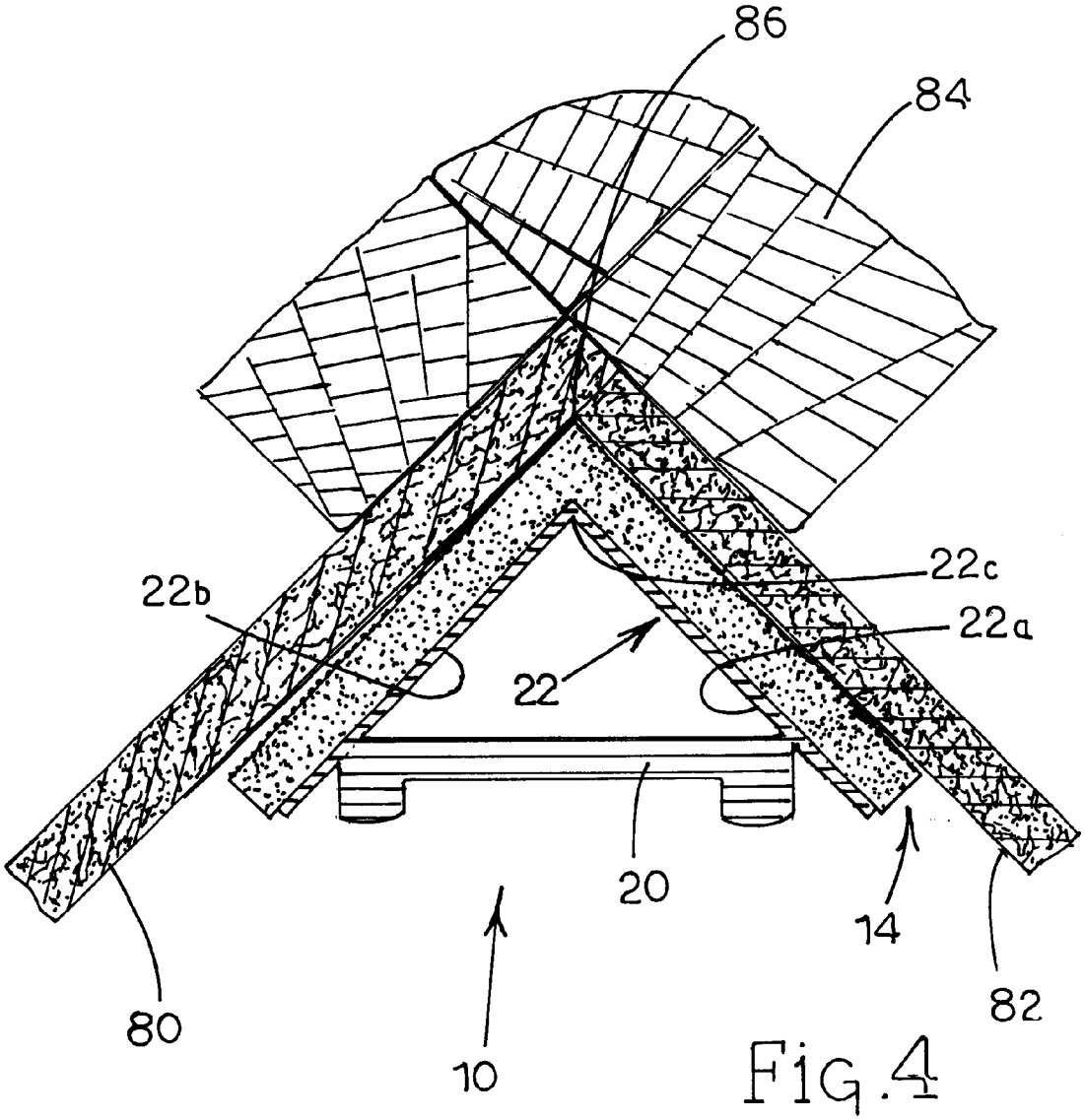
FIG. 4 is a cross-sectional view illustrating how the drywall sander of the present invention sands and finishes a drywall corner.

Turning to FIG. 4, the drywall sander 10 is shown therein and disposed within a drywall corner where the sander 10 assumes a sanding and finishing position within the drywall corner. Before discussing the sanding operation, it will be noted that the drywall corner is formed by a stud wall structure 84 and a pair of wall surfaces 80 and 82. The wall surfaces 80 and 82 form the outer face of a pair of drywall boards or sheets of sheet rock. In any event, it is seen that the wall surfaces 80 and 82 meet to form a juncture 86. Although the angle of a corner can vary, in conventional construction, a majority of the corners formed will be approximately 90 degrees.

In the case of the illustration of FIG. 4, the corner sander 10 is disposed in the corner such that the forward most edge 14*c* of the sanding pad 14 aligns with the juncture 86 formed by the wall surfaces 80 and 82. In one embodiment of the present invention, the angle formed by the outer exposed surfaces 14*a* and 14*b* of the sanding pad 14 is slightly less than the angle of the corner itself. In particular, if the angle formed by the drywall corner is approximately 90 degrees, the angle formed by the outer exposed surfaces 14*a* and 14*b* of the sanding pad 14 may be on the order of approximately 88 to 89 degrees or may be in the range of 80 to 89 degrees. However, the key point with respect to the embodiment illustrated in FIG. 4 is that the angle of the sanding pad is such that as the sanding pad 14 extends outwardly from the central portion of the corner or that area where the juncture 86 is formed, that the exposed outer sides 14*a* and 14*b* of the sanding pad 14 tend to be slightly spaced from the wall surfaces 80 and 82. This means that the sanding pad 10 is designed to more aggressively sand and finish the central area of the corner, that is that area of the corner about the juncture 86, than the areas that are spaced outwardly from the central portion of the corner. Expressed in another way, once the corner sander 10 is squarely positioned within the drywall corner, as illustrated in FIG. 4, the central portion of the sanding pad 14 will engage, sand and finish the central portion of the corner, and as the sanding pad 14 extends outwardly from the central portion of the corner, the sanding pad 14 will tend to be slightly spaced from the wall surfaces 80 and 82. This will have the effect of the sanding pad 14 more aggressively engaging and sanding the central portion of the corner and sanding less aggressively portions of the corner spaced outwardly from the central portion of the corner. This will result in the sanding pad 14 not forming elongated grooves or cuts in the drywall compound that is found just outwardly of the central portion of the corner. Effectively, by designing the pad holder 22 and the sanding pad 14 such that they generally conform to the shape and relationship shown in FIG. 4, one is able to avoid creating elongated grooves or slits in the drywall compound spaced just outwardly from the central portion of the drywall corner.

From the foregoing specification and discussion, it is appreciated that the drywall sander of the present invention provides a very efficient and effective means of sanding and finishing a drywall corner. It is appreciated that an extension pole can be inserted into the pole sleeve 46 and the drywall finisher can reach extended areas by extending the pole and the sander 10 to elevated heights. In addition, as discussed above, in one embodiment of the present invention, the sander is configured such that the sanding pad will vary in intensity from the central area of the drywall corner outwardly therefrom. In particular, the outer portions of the sanding pad 14 will not engage the adjacent wall surfaces 80 and 82 as aggressively as the central portion of the sander 10 engages the central portion of the drywall corner. Consequently, the drywall sander 10 avoids cutting grooves and slits in the drywall compound spaced outwardly from the central portion of the drywall corner.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A drywall sander for sanding a corner formed by two wall surfaces that meet at a juncture, comprising: a carrier, the carrier including a generally V-shaped support having a central edge and a pair of outer planar surfaces; the generally V-shaped support adapted to receive and support a generally v-shaped sanding pad having a central edge and a pair of outer planar sanding surfaces; wherein the outer planar surfaces of the V-shaped support extends substantially the entire width of the planar sanding surfaces of the sanding pad such that substantially the entire sanding pad is supported and backed by the V-shaped support of the carrier; and wherein the planar surfaces of the V-shaped support and the planar sanding surfaces of the sanding pad are all generally configured such that when the sander is squarely set into the corner to be sanded, the spacing between both the planar surfaces of the V-shaped support and the planar sanding surfaces of the sanding pad become greater as the planar surfaces of the V-shaped support and the sanding surfaces of the sanding pad extend outwardly from the juncture of the corner being sanded resulting in the planar sanding surfaces of the sanding pad extending further away from the two walls surfaces as the sanding surfaces of the sanding pad extend away from the juncture of the corner, thereby defining opposed spaces on opposite sides of the sander between the two wall surfaces of the corner and the outer portions of the planar sanding surfaces of the sanding pad which results in the sanding pad more aggressively sanding the areas in and around the juncture and sanding less aggressively the areas of the corner outwardly of the juncture.

2. The drywall sander of claim 1 wherein the planar sanding surfaces of the sanding pad and the outer planar sanding surfaces of the V-shaped support are disposed in general parallel relationship.

3. The drywall sander of claim 2 wherein the planar sanding surfaces of the sanding pad and the outer planar surfaces of the V-shaped support assume angles of slightly less than 90 degrees.

4. The drywall sander of claim 1 wherein the sanding pad is permanently mounted to the outer planar surfaces of the V-shaped support of the carrier.

5. The drywall sander of claim 1 wherein the generally V-shaped sanding pad is detachably mounted to the V-shaped support of the carrier through a fastener and wherein the fastener comprises a hook and loop fastener.

* * * * *